US008162033B2

(12) United States Patent
Weyer et al.

(10) Patent No.: US 8,162,033 B2
(45) Date of Patent: Apr. 24, 2012

(54) STRAND GUIDING DEVICE AND METHOD OF OPERATING IT

(75) Inventors: Axel Weyer, Wuppertal (DE); Axel Stavenow, Duesseldorf (DE)

(73) Assignee: SMS Demag Aktiengesellschaft, Duesseldorf (DE)

( * ) Notice: Subject to any disclaimer, the term of this patent is extended or adjusted under 35 U.S.C. 154(b) by 107 days.

(21) Appl. No.: 12/443,707

(22) PCT Filed: Oct. 2, 2007

(86) PCT No.: PCT/EP2007/008542
§ 371 (c)(1),
(2), (4) Date: Mar. 31, 2009

(87) PCT Pub. No.: WO2008/046507
PCT Pub. Date: Apr. 24, 2008

(65) Prior Publication Data

US 2010/0032125 A1 Feb. 11, 2010

(30) Foreign Application Priority Data

Oct. 13, 2006 (DE) ..... 10 2006 048 511

(51) Int. Cl.
*B22D 11/12* (2006.01)
*B22D 11/128* (2006.01)

(52) U.S. Cl. ..... 164/484; 164/442; 164/448

(58) Field of Classification Search ..... 164/484, 164/413, 454, 442, 448
See application file for complete search history.

(56) References Cited

U.S. PATENT DOCUMENTS

| | | | | |
|---|---|---|---|---|
| 5,348,074 | A | 9/1994 | Streubel | 164/476 |
| 5,511,606 | A | 4/1996 | Streubel | 164/476 |
| 6,199,621 | B1 * | 3/2001 | Weyer et al. | 164/484 |
| 6,276,436 | B1 | 8/2001 | Pleschiutschnigg | 164/476 |
| 6,463,996 | B1 * | 10/2002 | Streubel et al. | 164/441 |
| 6,568,460 | B1 * | 5/2003 | Kneppe et al. | 164/442 |
| 6,609,556 | B2 * | 8/2003 | Weyer et al. | 164/413 |
| 6,712,123 | B1 * | 3/2004 | Weyer et al. | 164/454 |
| 6,779,587 | B2 * | 8/2004 | Weyer et al. | 164/454 |
| 6,883,586 | B2 * | 4/2005 | Weyer et al. | 164/484 |
| 6,945,311 | B2 * | 9/2005 | Hulek | 164/476 |
| 2004/0188057 | A1 | 9/2004 | Hulek | |

FOREIGN PATENT DOCUMENTS

| | | |
|---|---|---|
| DE | 1583620 | 8/1970 |
| EP | 1018382 | 7/2000 |
| JP | 56111555 | 9/1981 |
| JP | 62127147 | 6/1987 |
| JP | 09220654 | 8/1997 |
| JP | 2002336944 | 11/2002 |

* cited by examiner

*Primary Examiner* — Kevin P Kerns
(74) *Attorney, Agent, or Firm* — Andrew Wilford

(57) ABSTRACT

A strand guide for a cast strand has a first roller bridge to one wide side of the cast strand and having ends defining two first section corners, a first fixed support adjacent the first roller bridge, a second roller bridge to the opposite wide side of the cast strand and having ends defining two second section corners, and a second fixed support adjacent the second roller bridge. Respective rows of rollers are rotatably mounted on each of the first and second roller bridges for engaging the respective wide sides and thereby supporting and guiding the cast strand. Respective first and second hydraulic positioners connect the first and second corners of the first and second roller bridges to the first and second fixed supports for individual positioning the rollers of the first and second roller bridges symmetrically or asymmetrically relative to the neutral phase of the cast strand.

1 Claim, 1 Drawing Sheet

STRAND GUIDING DEVICE AND METHOD OF OPERATING IT

CROSS REFERENCE TO RELATED APPLICATIONS

This application is the US national stage of PCT application PCT/EP2007/008542, filed 2 Oct. 2007, published 24 Apr. 2008 as WO2008/046507, and claiming the priority of German patent application 102006048511.4 itself filed 13 Oct. 2006, whose entire disclosures are herewith incorporated by reference.

FIELD OF THE INVENTION

The invention relates to a strand guide for supporting and guiding cast strands and a method of operating it in a strand-casting installation, in particular for slabs and thin slabs. The invention can be applied to all types of strand guides, in particular to vertical, horizontal, or curved setups. More precisely, the invention relates to positioning or adjusting roller bridges within a strand guide.

PRIOR ART

Strand guides with roller bridges for supporting and guiding cast strands are fundamentally known from the prior art.

DE 1 583 620 discloses an apparatus that handles cast strands with rollers, strand-guiding elements being provided with roller bridges that are pivoted at one end and whose other end can be moved radially so that the roller bridges can be set to a V-shaped relative to the neutral phase or also as the middle axis of the cast strand.

EP 0 834 364 [U.S. Pat. No. 6,276,436] discloses an apparatus for strand-casting installations with strand thickness reduction, in which opposing rollers are provided, the rollers of one side being fixed and the rollers of the other opposite side being urged toward the fixed rollers. In the process the roller bridge closest to the mold is pivoted at its end closer to the mold and the opposite end of the roller bridge can move. The roller bridges downstream of this first roller bridge are coupled together and are restricted in movement because of the coupling, one end of a roller bridge always being shifted jointly with another end of an adjacent roller bridge.

EP 0 545 104 [U.S. Pat. No. 5,348,074] also discloses an apparatus for strand casting, the apparatus having a fixed roller set and another second roller set that is biased toward this first roller set.

In the prior art, strand-casting installations are therefore known that either have one end fixed roller or provide a symmetrical arrangement of the rollers, resulting in a V-shaped roller gap. The drawback here is that fixed geometry results for the strand due to the rollers fixed on one side since the fixed side represents a reference point for the shiftable side. On the other hand the symmetrical V-shaped arrangement form a roller gap, due to the fixed intake arrangement of the first rollers, and the fixed mounting of the opposite rollers blocks movement during strand guiding and strand shaping.

OBJECT OF THE INVENTION

The object of the invention is therefore to provide an apparatus and a method that enable strand guidance and the strand to be made more flexible.

SUMMARY OF THE INVENTION

This object is attained in that the inventive strand guide in particular comprises at least one first positioner connecting the first roller bridge to a first fixed support and for individual positioning of the first roller bridge relative to the neutral phase of the cast strand and at least one second positioner connecting the second roller bridge to a second fixed support and for individual positioning of the second roller bridge relative to the neutral phase of the cast strand.

The neutral phase inside a not yet thoroughly solidified cast strand is the imaginary line connecting together the hottest points in the longitudinal direction of the strand, in each case viewed in cross-section of the strand. It cannot and indeed does not have to be the geometric centerline of the strand, in particular in the case of asymmetrical cooling.

The object of the invention advantageously enables adjustment of both roller bridges of a section on both sides of the cast strand independently of one another relative to the neutral phase of the cast strand. The reference point for setting and aligning the strand guiding or the roller bridges is no longer the roller path of the fixed side according to the invention, as in the prior art, but the neutral phase of the strand. The individual, i.e. independent, positioning as of now possible due to the invention, or adjustment of the roller bridges on both (wide) sides of the cast strand relative to the neutral phase of the strand or alternatively to its respective fixed supports, forms the basis for substantial improvement in quality during strand casting, in particular during manufacture of slabs. The strand-casting process is improved by the invention inasmuch as it enables individual support of the strand shell via the individually adjustable rows of rollers, whereby support can be given independently and flexibly with respect to the most optimal possible hardening process, but also with respect to desired soft reduction and/or with respect to liquid core reduction to be carried out.

In accordance with a first embodiment the positioners are mechanical elements and enable static setting of the individual position of the roller bridges relative to the neutral phase of the cast strand by spacers, so-called spacer blocks.

Alternatively, the positioners can also be configured as hydraulic actuators. The advantage here is that setting of or change to the positions of the roller bridges can also be done e.g. from a remotely arranged master display during operation of the strand guide.

Particularly stable positioning or adjustment of the roller bridges relative to the cast strand is achieved whenever the roller bridges are positioned in each case with four positioners provided in their respective corner regions. In particular, positioning at a specific angle $\alpha>0$ to the neutral phase of the cast strand is also possible.

The opposite roller bridges can be fastened either on the same or on a respective different fixed support. Advantageously, the fixed support is the section frame of the section. This is however by no means mandatory; rather, the fixed support can also be any fixed structural element of the strand-casting installation or in the vicinity of the strand-casting installation, e.g. a wall.

The above object is further attained by a method of operating the abovementioned strand guide. The advantages of this method correspond to the advantages mentioned above with respect to the apparatus.

In addition, it should be pointed out as a particular advantage that the inventive strand guide and the method enable both symmetrical and asymmetrical adjustment of the roller bridges relative to the neutral phase of the cast strand. With symmetrical adjustment the roller bridges are adjusted symmetrically, i.e. in each case at the same spacing from the neutral phase of the warm strand. With symmetrical adjustment the natural hardening procedure is followed, with the understanding also that all further process-control procedures, such as e.g. secondary cooling, are carried out with equal intensity on both sides of the cast strand. Symmetrical setting or adjusting also expressly includes symmetrical adjustment of the roller bridges on both sides of the cast strand at an angle $\alpha>0$ toward the neutral phase of the cast strand.

Asymmetrical adjustment of the roller bridges relative to the neutral phase of the cast strand can make sense in particular during a casting operation with respect to optimal section conicity/taper, with respect to liquid call reduction to be carried out, or with respect to soft reduction.

The change in symmetrical or asymmetrical adjustment of the roller bridges possible with the invention during the continuous-casting operation constantly enables optimal adaptation of the position of the roller bridges to the steel quality-dependent and casting speed-dependent parameter settings for the current casting process.

BRIEF DESCRIPTION OF THE DRAWING

Three figures are related to the invention, in which.

DETAILED DESCRIPTION

Figure 3:
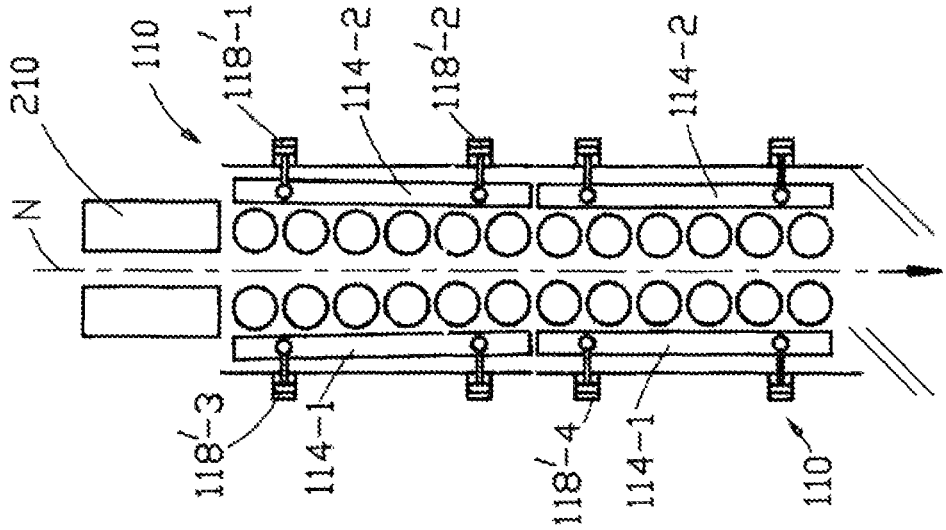
FIG. 3 shows the strand-casting installation with the strand guide according to the second embodiment in a third variant positioning the roller bridges.

The invention will be described in detail below with reference to figures. In all the figures the same elements are designated by the same reference numerals.

Figure 2:
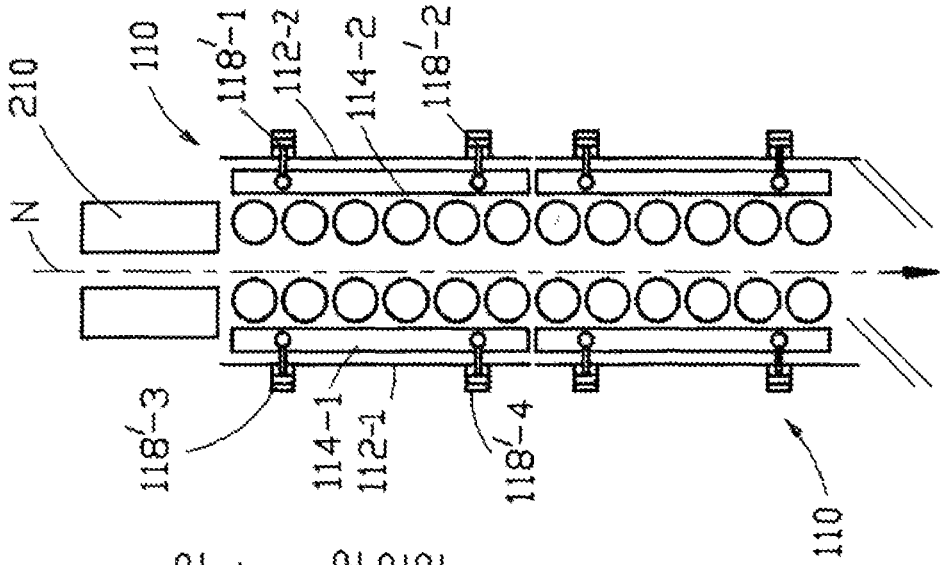
FIG. 2 shows the strand-casting installation with the strand guide according to a second embodiment in a second variant positioning the roller bridges.
Figure 1:
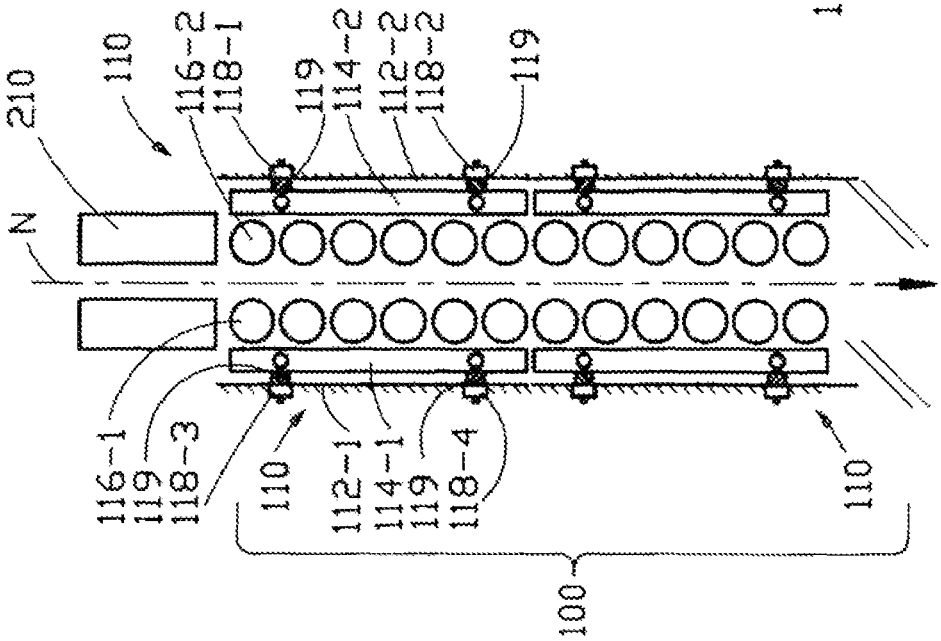
FIG. 1 shows a strand-casting installation with a strand guide according to a first embodiment in a first variant positioning the roller bridges.

FIG. 1 shows a strand-casting installation with a strand-casting mold 210 and a strand guide 100. The strand guide 100 comprises two sections 110 arranged one downstream of the other in the strand travel direction (arrow) of the mold 210. Each of the two sections 110 comprises a first roller bridge 114-1 on one wide side of the cast strand and a second roller bridge 114-2 on the opposite wide side of the cast strand. The cast strand is represented in FIGS. 1-3 by the vertical dot-dashed line. Each of the two roller bridges 114-1 and 114-2 comprises a plurality of respective rollers 116-1 and 116-2 for supporting and guiding the cast strand. The first roller bridge 114-1 can be shifted by four positioners 118 on a first fixed support 112-1, i.e. with variable spacing. Of the four first positioners only two are shown in FIG. 1, where they are designated by reference numerals 118-3 and 118-4. In similar fashion the second roller bridge 114-2 is mounted by four positioners on a second fixed support 112-2 to be variably positioned; of these positioners also only two are shown in FIG. 1 where they are designated by reference numerals 118-1 and 118-2. All the positioners serve for individual positioning or adjusting their respective roller bridges relative to the neutral phase N of the cast strand.

In FIG. 1 the fixed elements are mechanical according to a first embodiment. This means that individual adjustment of the roller bridges relative to the neutral phase of the cast strand is carried out by spacers 119 positioned near the positioners between the roller bridges and the fixed supports. The adjustments or settings of the roller bridges to the cast strand defined by the spacers cannot be altered during the continuous-casting operation and are in this respect static due to high temperatures prevailing during the casting operation in the region of the strand guide.

The adjustment of the roller bridges 114 shown in FIG. 1 relative to the neutral phase N of the cast strand is symmetrical according to a first variant, because the distances of the paired opposite roller bridges or single rollers from the neutral phase are the same value everywhere.

FIG. 2 differs on the one hand from FIG. 1 in that the positioners here according to a second embodiment are configured in the form of hydraulic cylinders 118'-1 . . . 118'-4. As already explained, this design of the positioners also enables modification of position of the roller bridges during the continuous-casting operation. This is advantageous particularly for preferably continuous adapting the positions of the bridges to any irregularities in the material thickness optionally caused by the cooling process in the cast strand, or to other casting parameters such as steel quality and casting speed during the continuous-casting operation.

In contrast to FIG. 1, FIG. 2 also shows asymmetrical positioning (second variant) of the roller bridges relative to the cast strand; this is shown FIG. 2 in that the left roller bridge 114-1 with its respective rollers has a lesser distance from the neutral phase of the cast strand than the opposite roller bridge 114-2 with its respective rollers.

In FIG. 3 the strand guide and in particular the positioners are configured hydraulically similarly to FIG. 2. In contrast to FIG. 2, FIG. 3 however shows symmetrical adjustment of the roller bridges to the neutral phase of the cast strand. In contrast to FIG. 1, the roller bridges 114-1 and 114-2 in FIG. 3 however are set not parallel to the neutral phase, but with a double-sided angle $\alpha>0$ to the neutral phase. This applies in FIG. 3 for the section directly downstream of the mold; for the downstream second section in the cast-strand travel direction however the roller bridges 114-1 and 114-2 are again arranged parallel to the neutral phase.

The invention claimed is:

1. A method of supporting and guiding a cast strand after leaving a strand casting mold in a strand guide having a first roller bridge on one of two opposite wide sides of the cast strand and having four corners, a second roller bridge on the other wide side of the cast strand and having four corners, and respective first and second rows of rollers on each of the bridges engaging the respective wide sides of the strand, the method comprising the steps of:

providing four respective first hydraulic positioners connecting the corners of the first roller bridge to a first fixed support and four respective second hydraulic positioners connecting the corners of the second roller bridge to a second fixed support, hydraulically positioning the first row of rollers by the first positioners at an acute angle to the neutral phase of the cast strand as the strand moves between the roller bridges, and hydraulically positioning the second row of rollers by the second positioners individually and independently of the positioning of the first set of rollers, asymmetrically to the first row of rollers relative to the neutral phase of the cast strand in the event of asymmetrical cooling and an asymmetrical neutral phase of the strand, and at an acute angle to the neutral phase of the cast strand as the strand moves between the roller bridges.

* * * * *